US009987764B2

(12) United States Patent
Campbell

(10) Patent No.: US 9,987,764 B2
(45) Date of Patent: Jun. 5, 2018

(54) TUBE INSERTION TOOL

(71) Applicant: Paul Campbell, Bend, OR (US)

(72) Inventor: Paul Campbell, Bend, OR (US)

(73) Assignee: PAUL HARVEY WOODWORKS, LLC, Bend, OR (US)

( * ) Notice: Subject to any disclaimer, the term of this patent is extended or adjusted under 35 U.S.C. 154(b) by 175 days.

(21) Appl. No.: 14/812,230

(22) Filed: Jul. 29, 2015

(65) Prior Publication Data

US 2017/0028582 A1 Feb. 2, 2017

(51) Int. Cl.

| | |
|---|---|
| ***B27G 11/00*** | (2006.01) |
| ***B27M 3/16*** | (2006.01) |
| ***B25B 9/02*** | (2006.01) |
| ***B43K 5/00*** | (2006.01) |

(52) U.S. Cl.

CPC ..... *B27G 11/00* (2013.01); *B25B 9/02* (2013.01); *B27M 3/16* (2013.01); *B43K 5/005* (2013.01)

(58) Field of Classification Search

CPC ..... B25B 9/02; B27G 11/00; B27M 3/16
USPC ... 294/3, 8.5, 16, 33, 93, 99.1, 99.2, 94, 96; 606/210, 133
See application file for complete search history.

(56) References Cited

U.S. PATENT DOCUMENTS 938,651 A * 11/1909 Doughty ..... A01G 23/046 111/101
1,758,490 A * 5/1930 Aderer ..... A61C 13/12 294/99.2
2,042,985 A * 6/1936 Gardella ..... A61B 17/30 294/99.2
2,082,062 A 6/1937 Johnson
3,019,521 A * 2/1962 Clark ..... B23Q 3/18 29/278
3,136,040 A * 6/1964 Bauer ..... H01R 43/26 173/91
3,399,583 A * 9/1968 Hall ..... G04D 1/021 294/99.2
3,752,017 A 8/1973 Lloyd et al.
4,634,165 A * 1/1987 Russell ..... B25B 9/02 294/99.2
D331,800 S * 12/1992 Han ..... D24/143
5,192,106 A * 3/1993 Kaufman ..... B25B 9/02 294/16

(Continued)

OTHER PUBLICATIONS

Search Report/Written Opinion—Corresponding PCT Application No. PCT/US16/43196, dated Dec. 28, 2016, 10 pages.

*Primary Examiner* — Paul T Chin
(74) *Attorney, Agent, or Firm* — Leber IP Law; Celia H. Leber

(57) ABSTRACT

Tube insertion devices are configured to allow a user to manually insert a hollow tube into a receiving bore, e.g., a pen tube into the bore of a blank. In some implementations, the devices include (a) a pair of elongated arms, each arm comprising a gripping portion and an insertion portions, each of the insertion portions terminating in a distal tip, and (b) a connecting portion joining the arms such that the arms pivot about the connecting portion in a plane defined by the arms when the gripping portions are pressed together by a user. Each of the insertion portions preferably includes a relatively wider proximal portion and a relatively narrower distal tube-carrying portion, the change in width between the proximal portion and the distal portion defining a stop surface.

23 Claims, 6 Drawing Sheets

(56) References Cited

U.S. PATENT DOCUMENTS

| | | | | |
|---|---|---|---|---|
| 5,197,498 | A * | 3/1993 | Stewart | A61C 15/046 132/323 |
| 6,235,027 | B1 * | 5/2001 | Herzon | A61B 18/085 606/28 |
| 7,959,756 | B2 | 6/2011 | Zimmermann | |
| 8,049,107 | B2 * | 11/2011 | Dinh | H02G 3/14 174/50 |
| 8,727,408 | B1 | 5/2014 | Ruid | |
| 9,333,049 | B2 | 5/2016 | McDonald et al. | |
| 2004/0051327 | A1 * | 3/2004 | Yoon | A47G 21/103 294/99.2 |
| 2009/0102214 | A1 * | 4/2009 | Cho | B25B 9/02 294/99.2 |
| 2009/0240281 | A1 | 9/2009 | Andre | |
| 2009/0267372 | A1 * | 10/2009 | Chen | B25B 9/02 294/99.2 |
| 2010/0280544 | A1 | 11/2010 | Banks | |
| 2015/0148840 | A1 | 5/2015 | Francis | |

* cited by examiner

TUBE INSERTION TOOL

BACKGROUND

Woodworkers and other artisans make high quality, custom writing instruments (pens, mechanical pencils and the like) by shaping or turning a blank that is formed of wood or other materials to give the exterior of the blank an attractive shape. The blank is hollow, with a central bore that holds the components of the writing instrument. Before shaping or turning the blank, the artisan generally inserts a hollow support structure, known as a pen tube, into the bore in the blank. The pen tube is made of metal, e.g., brass, and is used to prevent the blank from breaking or other damage during machining. The pen tube is glued in place, typically with a fast curing cyanoacrylate adhesive, to secure it within the bore during the machining process. The pen tube also serves as a housing for the components of the writing instrument. In other applications the pen tube can allow a device, such as a magnifying glass or letter opener blade, to be attached to the machined blank with the blank serving as a handle.

Gluing the pen tubes in place is a challenging procedure. Pen tubes often end up poorly oriented in the bore, with the adhesive setting before the pen tube can be re-oriented correctly. This and other problems during insertion can ruin costly blanks. In other cases, the pen tube becomes stuck on the insertion tool. Adhesive often becomes stuck on the artisan's fingers, and may contaminate the pen tube or blank.

SUMMARY

The present disclosure features tube insertion devices that are configured to allow a user to manually insert a hollow tube into a receiving bore, e.g., a pen tube into the bore of a blank. The disclosure also features methods of using such devices.

In one aspect, the disclosure features a device comprising (a) a pair of elongated arms, each arm comprising a gripping portion and an insertion portion, each of the insertion portions terminating in a distal tip and comprising a relatively wider proximal portion and a relatively narrower distal tube-carrying portion, the change in width between the proximal portion and the distal portion defining a stop surface, and (b) a connecting portion joining the arms such that the arms pivot about the connecting portion in a plane defined by the arms when the gripping portions are pressed together by a user.

Some implementations include one or more of the following features.

The device may further comprise a pair of thumb grips, one disposed on each of the arms between the gripping portion and the insertion portion. Each of the thumb grips may include a concave arcuate outer surface. The thumb grips may be spaced from the connecting portion by a distance of about 2 to 3 inches.

In some cases, the device may have a length of about 5 to 7 inches, and each tube-carrying portion may have a length of about 1.3 to 1.8 inches. The device may be formed as a single integral piece. In some cases, at least the tube-carrying portion is formed of acetal homopolymer. The entire device may be formed of acetal homopolymer.

The connecting portion generally joins the arms in a manner such that the arms, when in a rest position, are spaced from each other and angled outward such that the insertion portions are spaced further apart than the gripping portions. For example, in the rest position, the distance between inner surfaces of the gripping portions adjacent the connecting portion may be about 0.35 to 0.40 inch, and the distance between the inner surfaces of the tube-carrying portions may be about 0.45 to 0.55 inch. The connecting portion may be configured to provide a spring force to return the arms to their rest position.

In some implementations, the gripping portions have a width that is greater than a width of the relatively wider proximal portions. The thumb grips may have a height greater than a height of the gripping portions, providing a raised feature to support a user's thumb.

In another aspect, the disclosure features a method comprising (a) applying pressure to gripping portions of a tube insertion device comprising: (i) a pair of elongated arms, each arm comprising a gripping portion and an insertion portion, and (ii) a connecting portion joining the arms such that the arms pivot about the connecting portion in a plane defined by the arms; (b) inserting, into a hollow tube, the insertion portions of the tube insertion device; (c) releasing pressure from the gripping portions to allow the insertion portions to move apart within the tube; (d) applying adhesive to an outer surface of the tube; and (c) using the tube insertion device to position the tube in a bore of a blank.

Some implementations include one or more of the following features.

The method may further include applying pressure to the gripping portions to remove the tube insertion device from the tube after the tube has been positioned in the bore. The tube insertion device may include thumb grips positioned between the gripping portions and the insertion portions, and applying pressure may include grasping the thumb grips using the thumb and index finger.

The method may further include, after removing the tube insertion device, machining the blank to alter the shape of an outer surface of the blank. For example, machining may include turning the blank on a lathe. In some cases, the method further includes placing pen components within the machined blank.

In some cases, each of the insertion portions comprises a relatively wider proximal portion and a relatively narrower distal tube-carrying portion, the change in width between the proximal portion and distal portion defining a stop surface, and the inserting step includes sliding the tube-carrying portions into the tube until the stop surfaces resist further insertion.

The adhesive may be a quick-setting adhesive, for example a cyanoacrylate.

The devices described herein allow a hollow tube to be easily inserted in a bore and properly oriented within the bore. In applications in which an adhesive is applied to the tube, e.g., in custom pen manufacturing, the device prevents the user from getting adhesive on his or her hands. This presents a significant advantage for artisans who otherwise would suffer damage to their skin from repeated exposure to adhesives such as cyanoacrylates. In some implementations, the device is formed of a material to which commonly used adhesives do not adhere well, and thus the device does not become fouled with adhesive even after repeated use. Some preferred devices are also lightweight, allowing the device to be easily carried in a pocket or bag. In some implementations, the device is configured to be used with a wide range of pen tube sizes, and to allow proper positioning regardless of the size of the tube.

DETAILED DESCRIPTION

Figure 1:
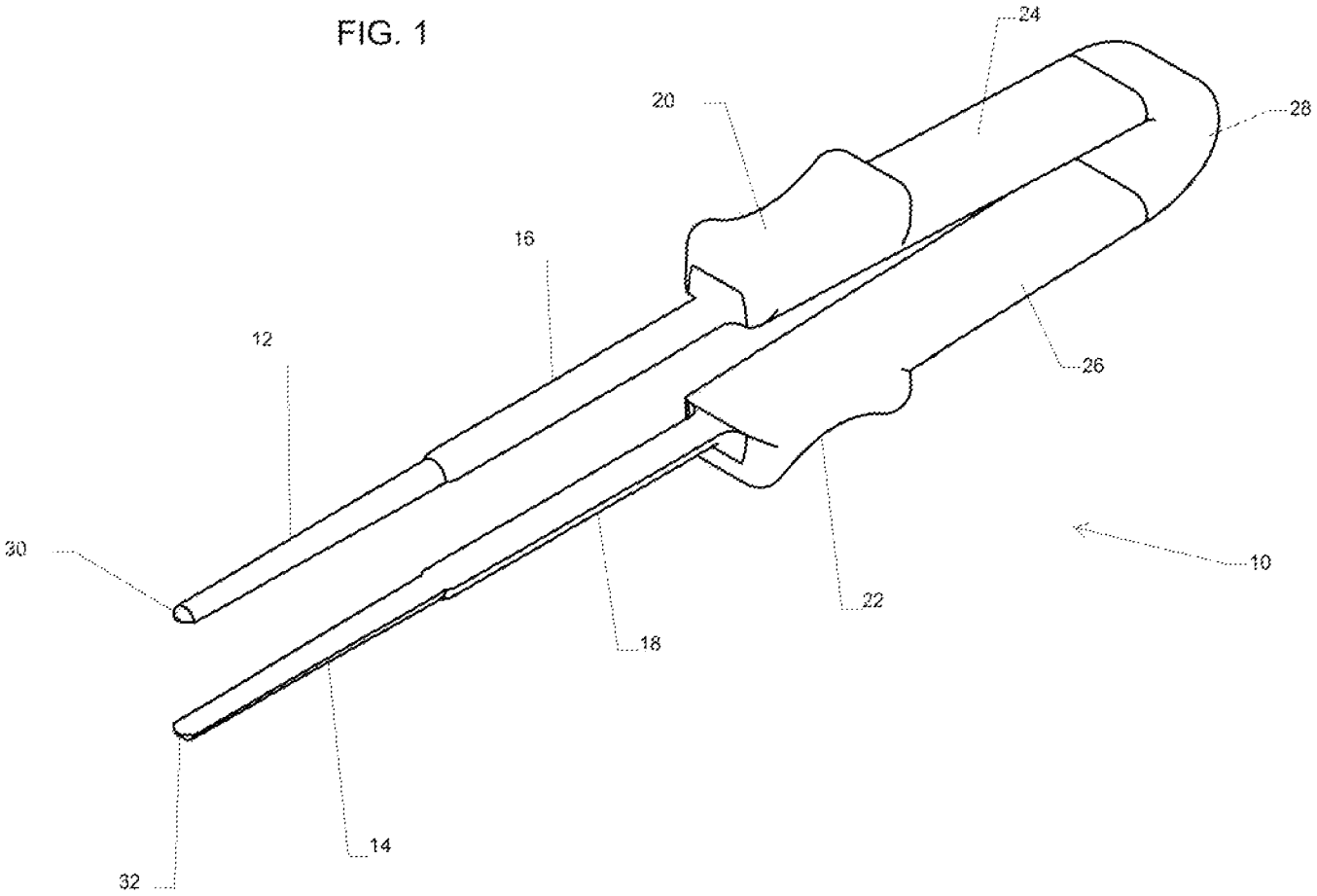
FIG. 1 is a perspective view of a tube insertion device according to one implementation.
Figure 2:
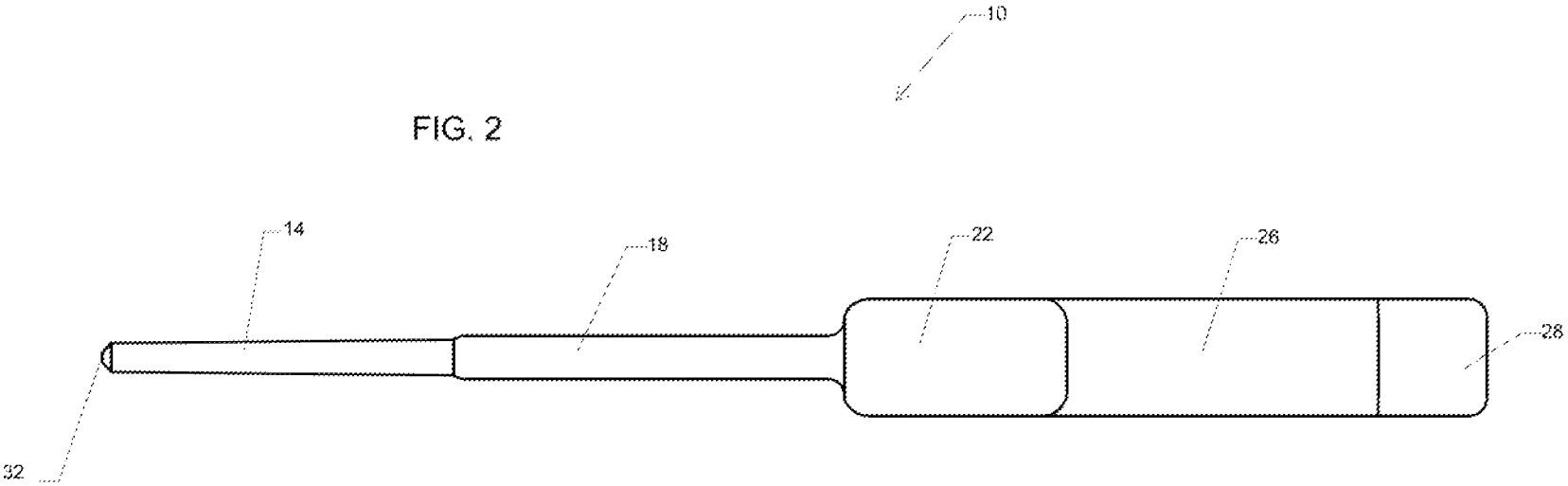
FIG. 2 is a side view of the device of FIG. 1.
Figure 3:
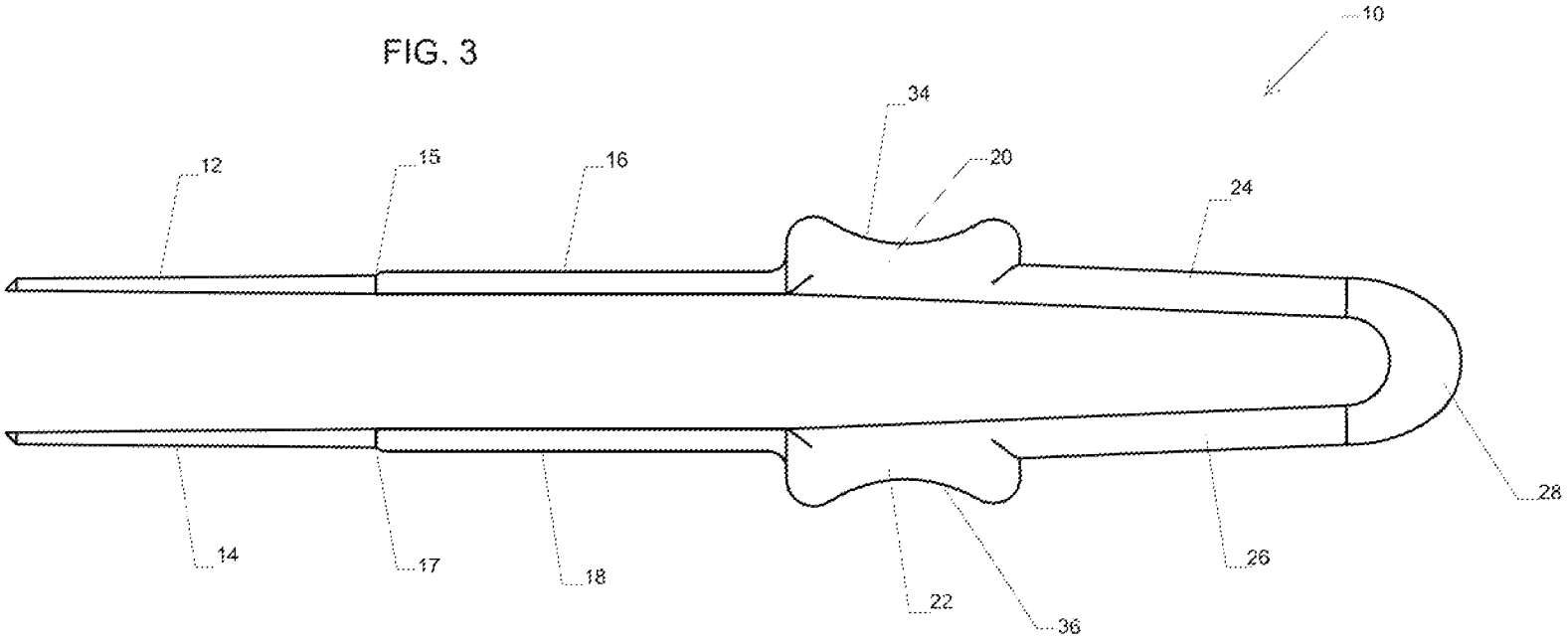
FIG. 3 is a front view of the device of FIG. 1.

A tube insertion device 10 is shown in FIGS. 1-3. The tube insertion device 10 includes a pair of elongated tube-carrying portions 12, 14, which extend from distal ends of elongated insertion portions 16, 18, and are configured for insertion into a pen tube or other elongated hollow tube. A thumb grip 20, 22, is disposed between each of the insertion portions 16, 18, and an associated gripping portion 24, 26. Together, tube-carrying portion 12, insertion portion 16, thumb grip 20 and gripping portion 24 define an elongated arm of the device, as do the opposed structures 14, 18, 22 and 16. The gripping portions and thumb grips provide a handle that is grasped by the user, while the tube-carrying portions and insertion portions are used to insert the tube into the bore.

The gripping portions, and thus the arms, are joined at their proximal ends by an arcuate connecting portion 28. In preferred implementations, the arms and the connecting portion are formed integrally, e.g., molded or cast as a single piece, of a resilient material. The arms pivot about the connecting portion, in the plane defined by the arms, with a pivoting movement similar to a pair of tongs. The resiliency of the material of which the device is made allows the user to press the tube-carrying portions toward each other by applying a compressive force to the gripping portions.

In some implementations, the device has an overall length of about 5 to 7 inches, with the tube-carrying portions having a length of about 1.2 to 1.8 inches, the insertion portions having a length of about 1.5 to 1.7 inches, the thumb grips having a length of about 0.7 to 1.0 inch, and the gripping portions having a length of about 2 to 3 inches.

Connecting portion 28 is bent at an acute angle, such that the tube-carrying portions are opposite each other, and is configured so that the tube-carrying portions are spaced apart a predetermined distance when the device is in a rest position (the position the device is in when no force is being applied to the gripping portions by a user). The spacing between the tube-carrying portions is selected so that when the device is in the rest position the outer surfaces of the tube-carrying portions are slightly further apart than the inner diameter of the tube to be inserted, and when the gripping portions are pressed toward each other the outer surfaces of the tube-carrying portions are closer together than the inner diameter of the tube. In some implementations, e.g., if the device is to be used with a standard 7 mm pen tube, in the rest position the outer surfaces of the tube-carrying portions are at least 0.3 inch apart, preferably at least 0.5 inch apart. For example, the outer surfaces may be from about 0.3 to 1.0 inch apart in the rest position.

The angle defined by the connecting portion 28 is preferably selected so that the spacing between the tube-carrying portions is slightly greater than the spacing between the gripping portions. For example, in some embodiments the inner surfaces of the gripping portions may be spaced about 0.35 to 0.40 inch apart, while the inner surfaces of the tube-carrying portions are spaced about 0.45 to 0.55 inch apart. This slight flaring outward of the arms of the device, combined with the resiliency of the material of which the device is made, causes the arms to be biased outwardly against the inner wall of the pen tube when the tube-carrying portions are pressed together, inserted into the tube, and allowed to expand outwardly toward their rest positions.

The connecting portion is preferably sufficiently thick so as to resist damage during repeated flexing of the arms of the device between their normal and compressed positions, and to maintain the desired spacing of the arms. Thus, it is generally preferred that the connecting portion not be a thin web of material, but rather have a thickness greater than that of the adjacent gripping portions as shown in FIG. 3. In some cases, the thickness of the connecting portion is at least 40% greater than that of the gripping portions, e.g., at least 50% greater.

In some cases, the connecting portion is configured to provide a spring force that urges the legs toward their rest position when the compressive force applied to the gripping portions is released. The connecting portion is also generally configured to resist torsional movement of the arms, or other movement of the arms in directions other than within the plane defined by the two arms.

Tube-carrying portions 12, 14 are dimensioned to easily slide into a pen tube when the gripping portions are squeezed, bringing the insertion portions together. As seen best in FIG. 2, the tube-carrying portions are slightly narrower than and have a height slightly less than that of the insertion portions. As a result, the junction of the proximal end of each tube-carrying portion and the distal end of the adjacent insertion portion defines a stop surface 15, 17 (FIG. 3.) These stop surfaces prevent a small diameter pen tube (e.g., a pen tube having a diameter of 7 mm or less) from sliding onto the insertion portions, allowing such tubes to be precisely positioned so that the tube will be properly oriented when inserted into the bore. When larger diameter pen tubes are used, the tube can slide beyond the stop surfaces and extend onto the insertion portions.

Preferably, the tube-carrying portions are dimensioned so that when the small diameter tube is positioned on the tube-carrying portions with its edge abutting the stop surfaces the tube will extend beyond the tips of the tube-carrying portions. In some cases, the tube will extend at least 0.15 inch beyond the tips. For example, when the device is to be used with standard 7 mm pen tubes, which typically have a length of about 2 to 2.5 inches, the tube-carrying portions generally have a length of less than 2 inches, e.g., from about 1.3 to 1.8 inches.

The tube-carrying portions generally taper slightly in width from their proximal to distal ends, as best seen in FIG. 2, and in height, as best seen in FIG. 3, to allow the tube to easily slide onto and off of the tube carrying portions. The difference in width and in height from the proximal to distal end can be, for example, from about 10% to 70%.

The tube-carrying portions preferably have an arcuate outer surface, shaped to correspond generally to the curvature of the inner surface of the pen tube. In some embodiments, the arcuate outer surface has a radius of curvature substantially equal to the radius of curvature of the smallest tube with which the device is to be used. For example, in some cases the radius of curvature may be substantially equal to the radius of curvature of a 7 mm pen tube when the device is used in pen making.

It is generally preferred that the distal tips 30, 32, of the tube-carrying portions be radiused, as shown, to help guide the tube-carrying portions into the bore of the tube. It is also generally preferable that the distal tips be blunt, rather than sharp, for safety and ease of use.

The insertion portions are dimensioned to be sufficiently thick and wide so as to prevent a small pen tube from sliding onto them (as discussed above regarding stop surfaces 15, 17), while being sufficiently small to fit within the bore of a blank, so that the pen tube can be centrally positioned within the blank. The length of the insertion portions is generally not critical, but is generally selected to be sufficiently long for insertion into a long, large diameter pen tube, and to provide the user with maneuverability and dexterity when inserting the tube in the blank. For example, the length of the insertion portions may be at least 1.25 inch, e.g., at least 1.5 inch, in some cases from about 1.5 inches to 3 inches.

The gripping portions are configured to provide the user with a secure and comfortable grip, and to allow the user to easily apply inward pressure to move the arms toward each other. Generally, the gripping portions have a width greater than that of the insertion portions, as shown, for ergonomics and durability of the device. For example, in some implementations the gripping portions may have a width of about 0.4 to 0.6 inch, while the insertion portions have a width of about 0.1 to 0.3 inch. The length of the gripping portions is preferably selected to roughly correspond to the width of a user's palm measured from the middle to little finger, and thus may be, for example, from about 2 to 3.5 inches.

The thumb grips are positioned at a sufficient length from the connecting portion to allow the user to easily deflect the arms without having to apply excessive force. In some preferred embodiments, the center of the thumb grip is positioned about 2.3 to 2.7 inches from the apex of the connecting portion.

The thumb grips preferably have a height greater than the height of the gripping portions, as shown, to provide a raised surface to support the thumb and a stop surface to prevent the fingers from sliding off of the gripping portions. For example, the highest point of the thumb grips may be at least 0.1 inch above the adjacent surface of the gripping portion, in some cases at least 0.3 inch.

Each of the thumb grips has a concave outer surface 34, 36 (FIG. 3.) These concave surfaces provide support for the user's thumb, enhancing user comfort and providing a secure grip when applying inward pressure to the gripping portions.

The device may be made of any desired material that provides an appropriate degree of resiliency to allow the arms to move as described above, for example of a resilient plastic or metal. However, in applications in which adhesives will be applied to the tube, for example in pen making processes that utilize quick-setting cyanoacrylate adhesives, it is preferred that the device be made of a material to which the adhesive will not adhere. In such applications, preferred materials include acetal polymers (polyoxymethylene), e.g., the acetal homopolymers sold by DuPont de Nemours under the tradename DELRIN® acetal resin, and other polymers to which the adhesive used would not adhere. Using an acetal resin allows the cyanoacrylate adhesive to be easily wiped off of the device, e.g., with a paper towel or cloth, even if the cyanoacrylate adhesive has hardened. Forming the device of a plastic allows the device to be easily manufactured, e.g., by injection molding, and to be lightweight for easy transport. In some cases, the device weighs less than 8 ounces, e.g., less than 4 ounces or in some cases 2 ounces or less.

To use the tube insertion device, a user would first squeeze the arms together by grasping the thumb grips and gripping portions and applying inward pressure. The user would then insert the tips 30, 32, into the bore of a tube and slide the device forward. If the tube is a small tube, e.g., a 7 mm tube, the device is inserted until the tube meets resistance from the stop surfaces 15, 17. If the tube is a larger diameter tube, the device may be inserted further, e.g., until the tube fits over a portion of or the entire insertion portions 16, 18.

Figure 4A:
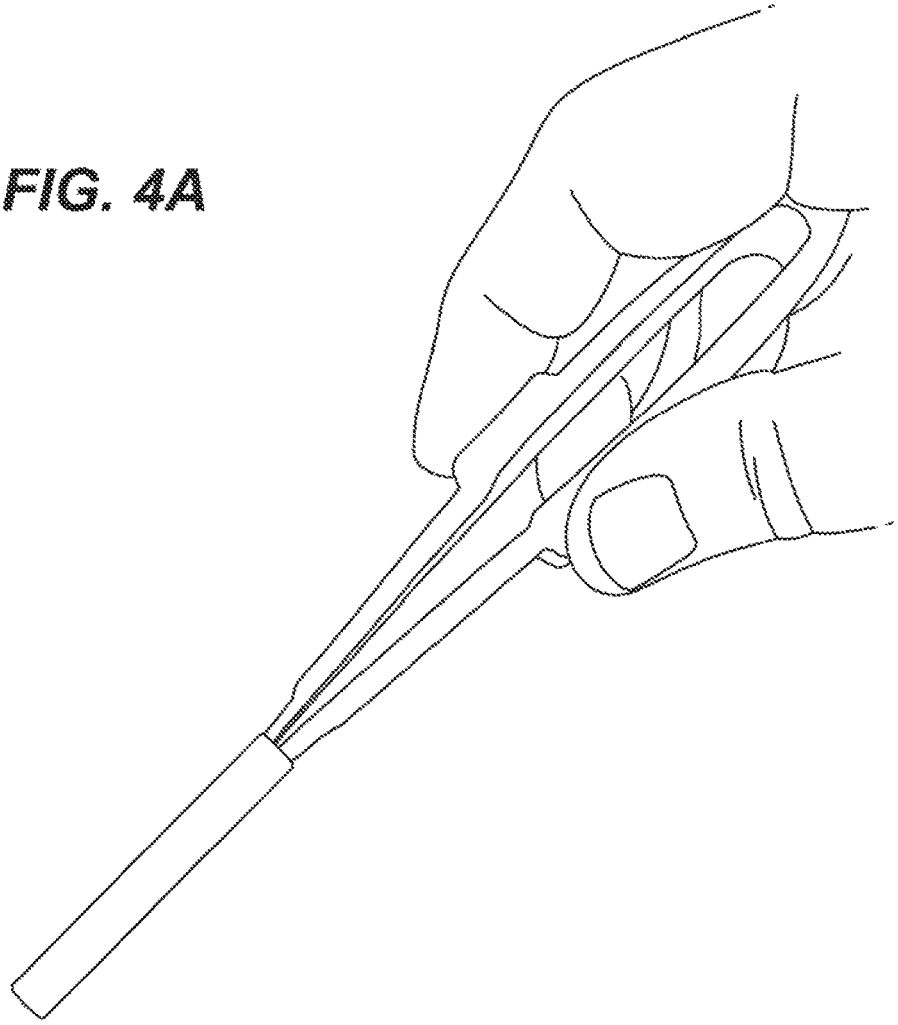
FIGS. 4A and 4B are perspective views showing the device of FIG. 1 with a pen tube disposed on the tube-carrying portions, and showing the device being used to insert the pen tube into the bore of a blank, respectively.
Figure 4B:
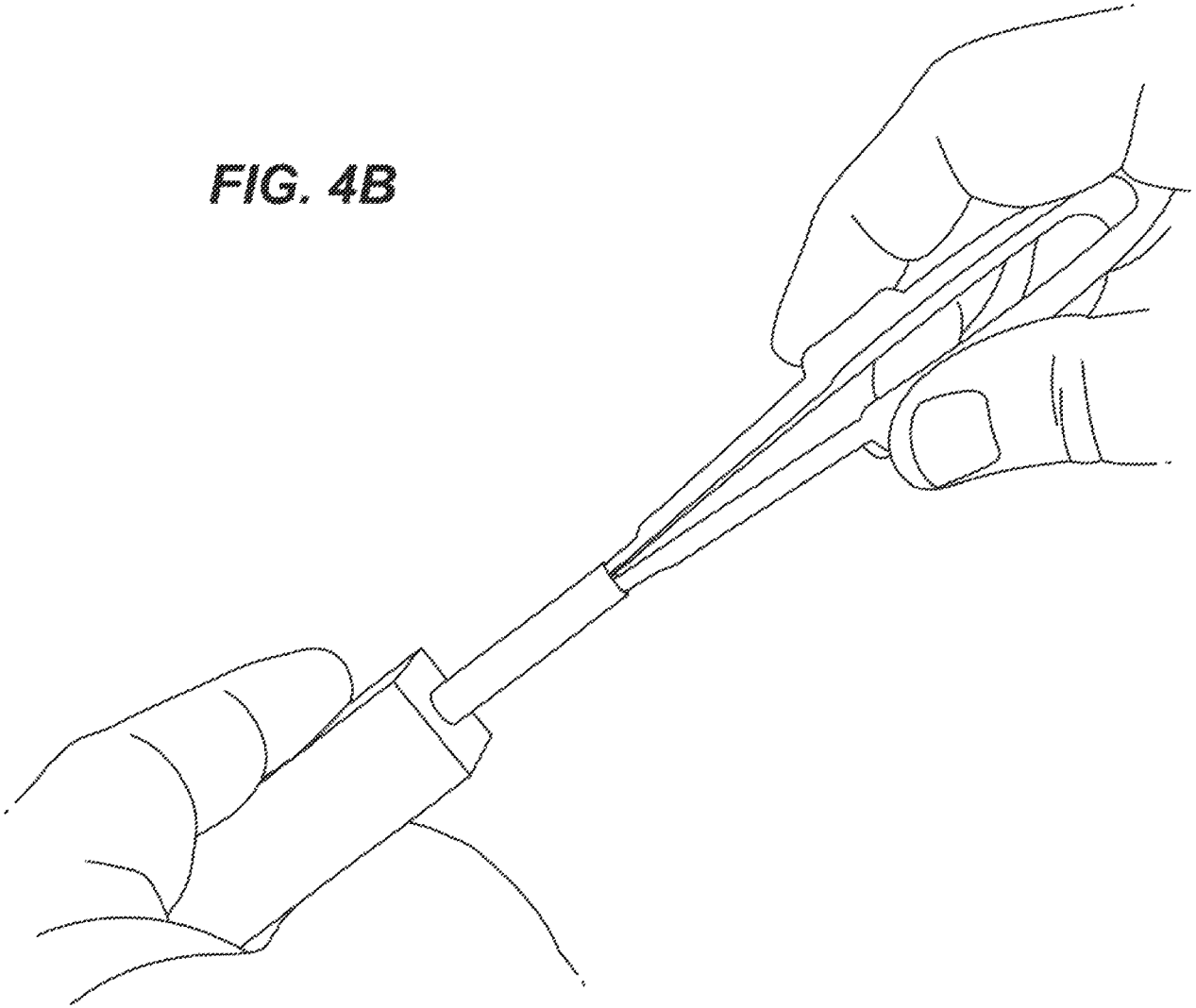
Figure 4C:
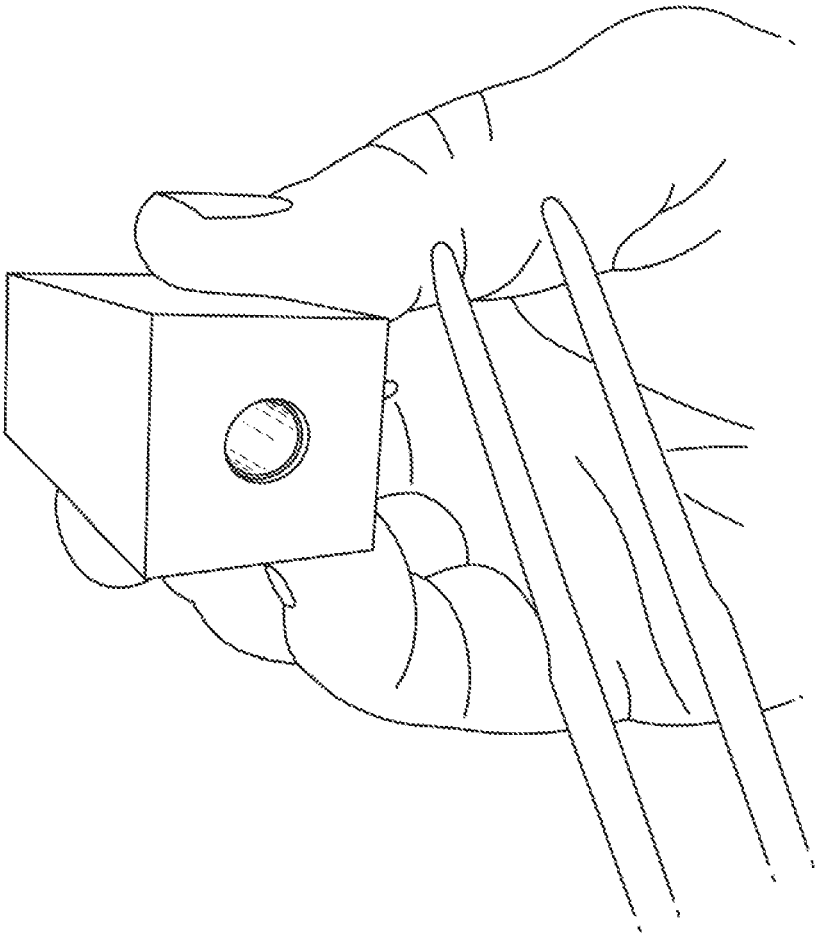
FIG. 4C is a perspective view showing the pen tube inserted in the blank.

At this point, the tube is carried by the tube-carrying portions, as shown in FIG. 4A, with the tube in some cases extending slightly beyond tips 30, 32. The user can then sand the tube, if necessary, and apply an adhesive to the tube, for example a quick-setting cyanoacrylate adhesive. The user then slides the tube into the bore of a blank, as shown in FIG. 4B, and orients the tube in the desired position within the bore. It is generally preferred that the user also twist the tube back and forth within the bore to distribute the adhesive evenly over the surface of the tube and opposing surface of the bore. Once the tube is properly oriented, the user again presses the gripping portions together to release the tube-carrying portions from the tube, leaving the tube within the bore as shown in FIG. 4C. In this manner, the device can easily be removed from the tube without risk of the tube being inadvertently pulled out with the device.

After the device has been removed, the user can perform subsequent steps as is well known in the art, e.g., machining the blank (for example by turning the blank on a lathe), performing other finishing steps on the blank, and inserting pen components or other parts into the pen tube within the blank.

OTHER EMBODIMENTS

A number of embodiments have been described. Nevertheless, it will be understood that various modifications may be made without departing from the spirit and scope of the disclosure.

For example, while the tools described herein have been discussed in the context of pen manufacture, the tools can be used to make other types of products with custom machined handles, for example magnifying glasses, ice cream scoops, razors, and the like.

Moreover, the tube insertion tools may be scaled for use in many other applications in which a hollow male tube needs to be inserted into a female bore. The dimensions provided herein are merely by way of example, and can be varied as needed for a particular application or user group.

As another example, while it is generally preferred that the tube insertion device have thumb grips, these elements can be omitted if desired.

Accordingly, other embodiments are within the scope of the following claims.

What is claimed is:

1. A device comprising:

a pair of elongated arms, each arm having an inner surface, facing the other arm, and an opposite outer surface, and each arm comprising a gripping portion and an insertion portion, each of the insertion portions terminating in a distal tip and comprising a relatively wider proximal portion and a relatively narrower distal tube-carrying portion, the change in width between the proximal portion and the distal portion defining a stop surface disposed on the outer surface of the arm, and an arcuate connecting portion joining the arms such that the arms pivot about the connecting portion in a plane defined by the arms when the gripping portions are pressed together by a user, wherein the connecting portion is integral with the arms, and comprises a web of resilient material that joins the arms in a manner such that the arms, when in a rest position, are spaced from each other and angled outward such that the insertion portions are spaced further apart than the gripping portions.

2. The device of claim 1 further comprising a pair of thumb grips, one disposed on each of the arms between the gripping portion and the insertion portion.

3. The device of claim 2 wherein each of the thumb grips includes a concave arcuate outer surface.

4. The device of claim 2 wherein each of the thumb grips is spaced from the connecting portion by a distance of from about 2 to 3 inches.

5. The device of claim 1 wherein each tube-carrying portion has a length of about 1.3 to 1.8 inches.

6. The device of claim 1 wherein the device is formed as a single integral piece.

7. The device of claim 6 wherein the device is formed of acetal homopolymer.

8. The device of claim 1 wherein at least the tube-carrying portion is formed of acetal homopolymer.

9. The device of claim 1 wherein the connecting portion is configured to provide a spring force to return the arms to their rest position.

10. The device of claim 1 wherein, in the rest position, the distance between inner surfaces of the gripping portions adjacent the connecting portion is about 0.35 to 0.40 inch, and the distance between the inner surfaces of the tube-carrying portions is about 0.45 to 0.55 inch.

11. The device of claim 1 wherein the gripping portions have a width that is greater than a width of the relatively wider proximal portions.

12. The device of claim 1 wherein the device has a length of from about 5 to 7 inches.

13. The device of claim 1 wherein the connecting portion has a thickness that is greater than a thickness of the gripping portions.

14. A method comprising:

applying pressure to gripping portions of a tube insertion device comprising:

(a) a pair of elongated arms, each arm having an inner surface, facing the other arm, and an opposite outer surface, and each arm comprising a gripping portion and an insertion portion, each of the insertion portions terminating in a distal tip and comprising a relatively wider proximal portion and a relatively narrower distal tube-carrying portion, the change in width between the proximal portion and the distal portion defining a stop surface disposed on the outer surface of the arm, and (b) a connecting portion joining the arms such that the arms pivot about the connecting portion in a plane defined by the arms, wherein the connecting portion is integral with the arms, and comprises a web of resilient material that joins the arms in a manner such that the arms, when in a rest position, are spaced from each other and angled outward such that the insertion portions are spaced further apart than the gripping portions;

inserting, into a hollow tube, the insertion portions of the tube insertion device;

releasing pressure from the gripping portions to allow the insertion portions to move apart within the tube;

applying adhesive to an outer surface of the tube; and using the tube insertion device to position the tube in a bore of a blank.

15. The method of claim 14 further comprising applying pressure to the gripping portions to remove the tube insertion device from the tube after the tube has been positioned in the bore.

16. The method of claim 15 further comprising, after removing the tube insertion device, machining the blank to alter the shape of an outer surface of the blank.

17. The method of claim 16 wherein machining comprises turning the blank on a lathe.

18. The method of claim 16 further comprising placing pen components within the machined blank.

19. The method of claim 14 where the tube insertion device further comprises thumb grips positioned between the gripping portions and the insertion portions, and applying pressure comprises grasping the thumb grips using the thumb and index finger.

20. The method of claim 14 wherein the adhesive comprises a cyanoacrylate.

21. The method of claim 14 wherein the inserting step includes sliding the tube-carrying portions into the tube until the stop surfaces resist further insertion.

22. A device comprising:

a pair of elongated arms, each arm comprising a gripping portion and an insertion portion, each of the insertion portions having an arcuate outer surface and a generally flat inner surface, such that the insertion portions are substantially D shaped in cross-section, and an arcuate connecting portion joining the arms such that the arms pivot about the connecting portion in a plane defined by the arms when the gripping portions are pressed together by a user, wherein each arm has an inner surface, facing the other arm, and an opposite outer surface, and each arm comprises a stop surface disposed on the outer surface of the arm, wherein the connecting portion is integral with the arms, and comprises a web of resilient material that joins the arms in a manner such that the arms, when in a rest position, are spaced from each other and angled outward such that the insertion portions are spaced further apart than the gripping portions.

23. The device of claim 22 wherein the insertion portions terminate in a radiused distal tip.

* * * * *